US011542895B2

(12) United States Patent
Dudar

(10) Patent No.: US 11,542,895 B2
(45) Date of Patent: Jan. 3, 2023

(54) METHOD AND SYSTEM FOR DETERMINING VAPOR STORAGE CANISTER RESTRICTION

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/302,755

(22) Filed: May 11, 2021

(65) Prior Publication Data

US 2022/0364530 A1 Nov. 17, 2022

(51) Int. Cl.
*F02M 25/08* (2006.01)

(52) U.S. Cl.
CPC ..... *F02M 25/0827* (2013.01); *F02M 25/089* (2013.01); *F02M 25/0836* (2013.01); *F02M 25/0854* (2013.01); *F02M 25/0872* (2013.01)

(58) Field of Classification Search
CPC ..... F02M 25/0809; F02M 25/0827; F02M 25/0836; F02M 25/0854; F02M 25/0872; F02M 25/089
See application file for complete search history.

(56) References Cited

U.S. PATENT DOCUMENTS 5,158,054 A * 10/1992 Otsuka ..... F02M 25/0809 123/520
5,765,540 A * 6/1998 Ishii ..... F02M 37/20 123/198 D
9,732,685 B2 8/2017 Dudar
10,513,997 B2 12/2019 Dudar
10,683,830 B2 * 6/2020 Ooiwa ..... F02M 25/0854
10,830,189 B1 11/2020 Dudar
11,008,980 B1 * 5/2021 Koo ..... F02D 41/0002
11,313,293 B2 * 4/2022 Kato ..... B01D 53/0454
2009/0007890 A1 * 1/2009 Devries ..... F02M 25/089 123/520
2014/0257721 A1 * 9/2014 Thompson ..... G07C 5/00 73/49.3
2016/0356247 A1 * 12/2016 Dudar ..... F02M 25/0809
2017/0130659 A1 * 5/2017 Dudar ..... F02M 25/0836
2019/0277180 A1 9/2019 Dudar
2019/0360434 A1 * 11/2019 Dudar ..... F02M 25/0854
2020/0102899 A1 * 4/2020 Andrzejewski ..... F02M 25/089
(Continued)

FOREIGN PATENT DOCUMENTS

CN 102678396 A 9/2012

OTHER PUBLICATIONS

Dudar, A., "CPV Robustness Method for a Vehicle Evaporative Emissions Control System," U.S. Appl. No. 17/150,248, filed Jan. 15, 2021, 65 pages.

*Primary Examiner* — Sizo B Vilakazi
*Assistant Examiner* — Anthony L Bacon
(74) *Attorney, Agent, or Firm* — Vincent Mastrogiacomo; McCoy Russell LLP

(57) ABSTRACT

Methods and systems for determining pressure changes across at least two fuel vapor storage canisters are described. The methods and systems may include determining the pressure changes via a sole pressure sensor. In one example, fuel vapor canister bypass passages are provided to determine pressure values at a plurality of positions within an evaporative emissions system.

18 Claims, 7 Drawing Sheets

(56) References Cited

U.S. PATENT DOCUMENTS

| | | | | |
|---|---|---|---|---|
| 2020/0369508 | A1 | 11/2020 | Dudar | |
| 2022/0065201 | A1* | 3/2022 | Honda | F02M 25/08 |
| 2022/0099051 | A1* | 3/2022 | Ishihara | F02M 25/0836 |

* cited by examiner

400

| | 402 | 404 | 406 |
|---|---|---|---|
| 408 | Excitation | PS1 (Abs) | Result |
| 410 | Engine manifold vacuum | zero | Missing canister |
| 412 | Engine manifold vacuum | 12 “$H_2O$ | Canister loaded If refueling Occured |
| 414 | Engine manifold vacuum | 6 “$H_2O$ | Canister baseline |
| 416 | Engine manifold vacuum | 20 “$H_2O$ | Canister degraded |

FIG. 4

METHOD AND SYSTEM FOR DETERMINING VAPOR STORAGE CANISTER RESTRICTION

FIELD

The present description relates generally to methods and systems for determining vapor canister restriction for an evaporative emissions control system.

BACKGROUND/SUMMARY

A vehicle may include an evaporative emissions control system to reduce release of fuel vapors from the vehicle into the atmosphere. The evaporative emissions control system may include a fuel vapor storage canister. Carbon within the fuel vapor storage canister may hold and release fuel vapors. The carbon's capacity to store fuel vapors may degrade over time due to water and/or liquid fuel entering the fuel vapor storage canister. In addition, the carbon may breakdown from its pellet form into a dust form. The dust form of carbon may store less fuel vapor than the pellet form. One way to increase the likelihood of fuel vapors being stored in carbon is to increase a volume of carbon in which the fuel vapors may be stored. However, a single canister with sufficient volume to store a desired amount of fuel vapor may not conform to vehicle packaging constraints and a new large volume canister that meets storage requirements may be cost prohibitive as compared to existing smaller canisters. Therefore, it may be desirable to provide an evaporative emissions system that has fuel vapor storage capacity to meet requirements and diagnostics that allows the larger volume to be evaluated for functionality.

The inventors herein have recognized the above-mentioned issue and have developed a method for operating an engine, comprising: estimating a pressure change across a fuel vapor storage canister via a controller according to a first pressure and a second pressure, the first pressure and second pressure indicated via a pressure sensor; and indicating a presence or absence of a restriction of the fuel vapor storage canister that is greater than a threshold according to the pressure change across the fuel vapor storage canister via the controller.

By selectively opening and closing one or more fuel vapor storage canister bypass passages, it may be possible to provide the technical result of providing diagnostics for a large volume fuel vapor storage system at reduced cost. In particular, bypass passages around two or more fuel vapor storage canisters may be selectively opened and closed so as to allow pressures along a plurality of fuel vapor storage canisters that are arranged in series to be determined. Pressure drops across the serially arranged fuel vapor storage canisters may be determined from individual pressures that were determined via opening and closing the bypass passages. Thus, with a single pressure sensor, it may be possible to determine whether or not a large volume of carbon may be degraded.

The present description may provide several advantages. In particular, the approach may allow large amounts of fuel vapor to be stored. Additionally, the approach may allow a large volume of fuel vapor storage material to be evaluated for degradation via a single pressure sensor. Further, the approach provides for mitigating actions if a fuel vapor storage canister is determined to be degraded.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 4 shows table of example evaporative emissions system diagnostic values;

DETAILED DESCRIPTION

Figure 2:
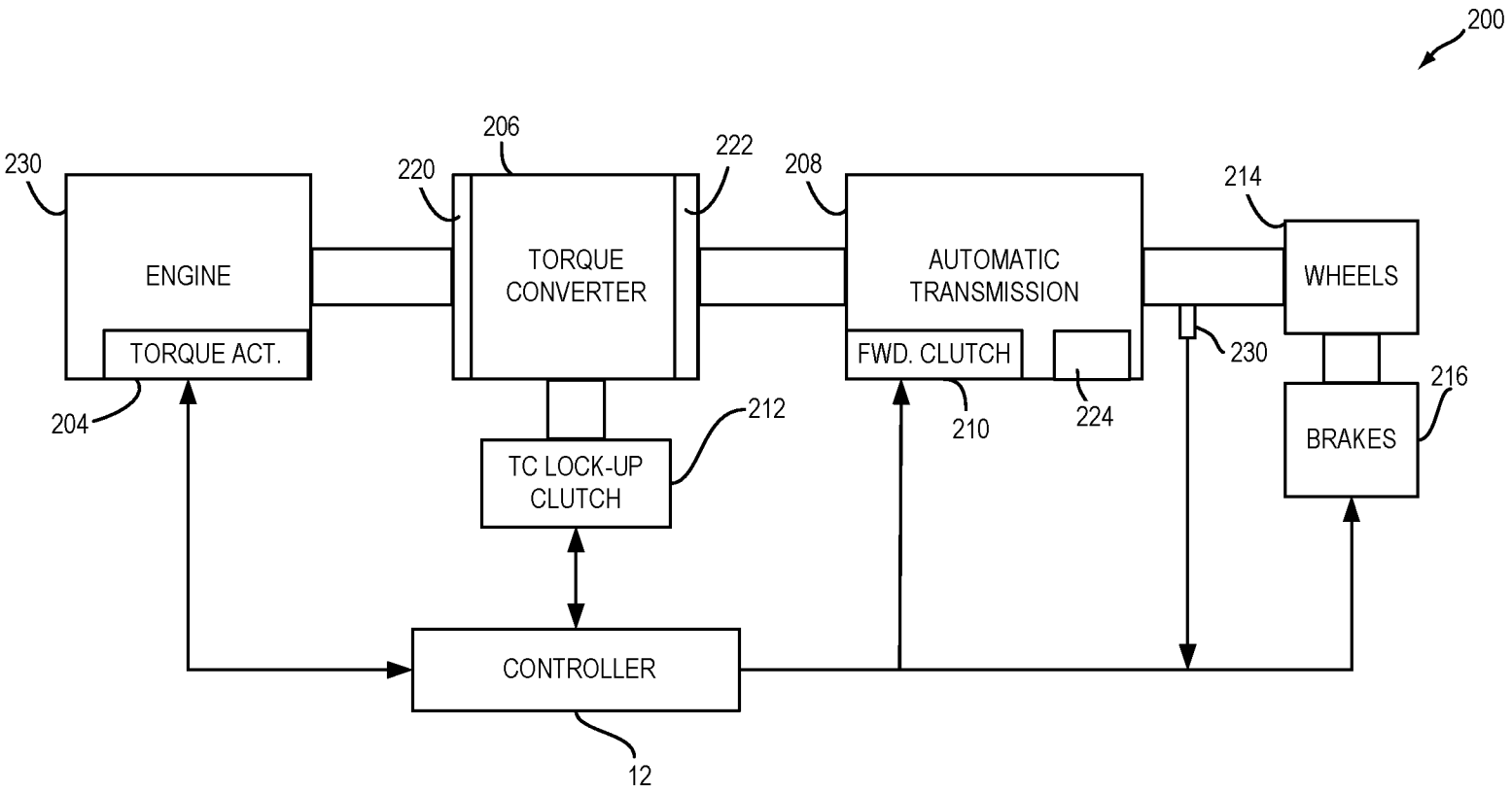
FIG. 2 shows an example powertrain of the vehicle that includes the engine.
Figure 3:
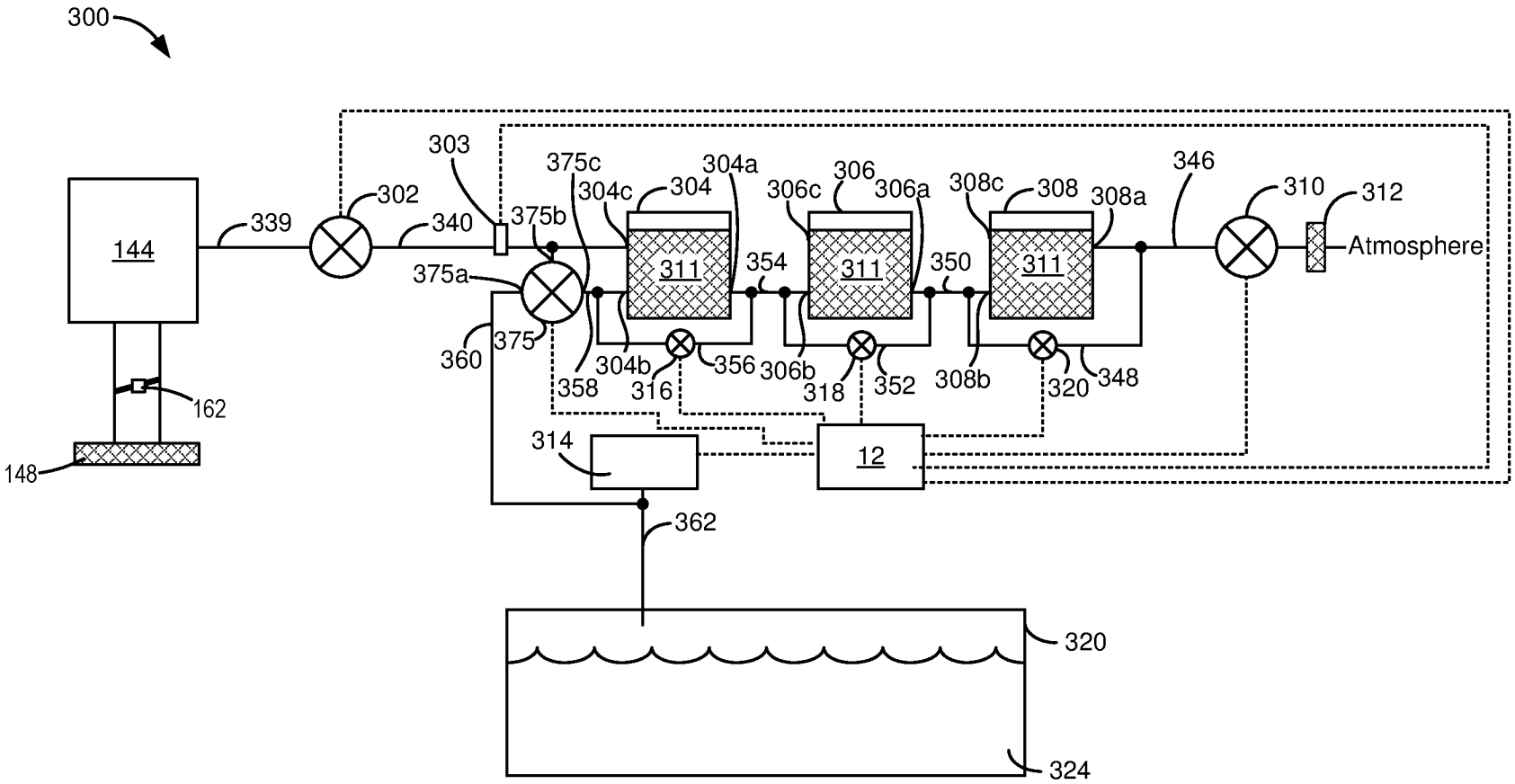
FIG. 3 shows a block diagram of an example evaporative emissions system for the vehicle.
Figure 5:
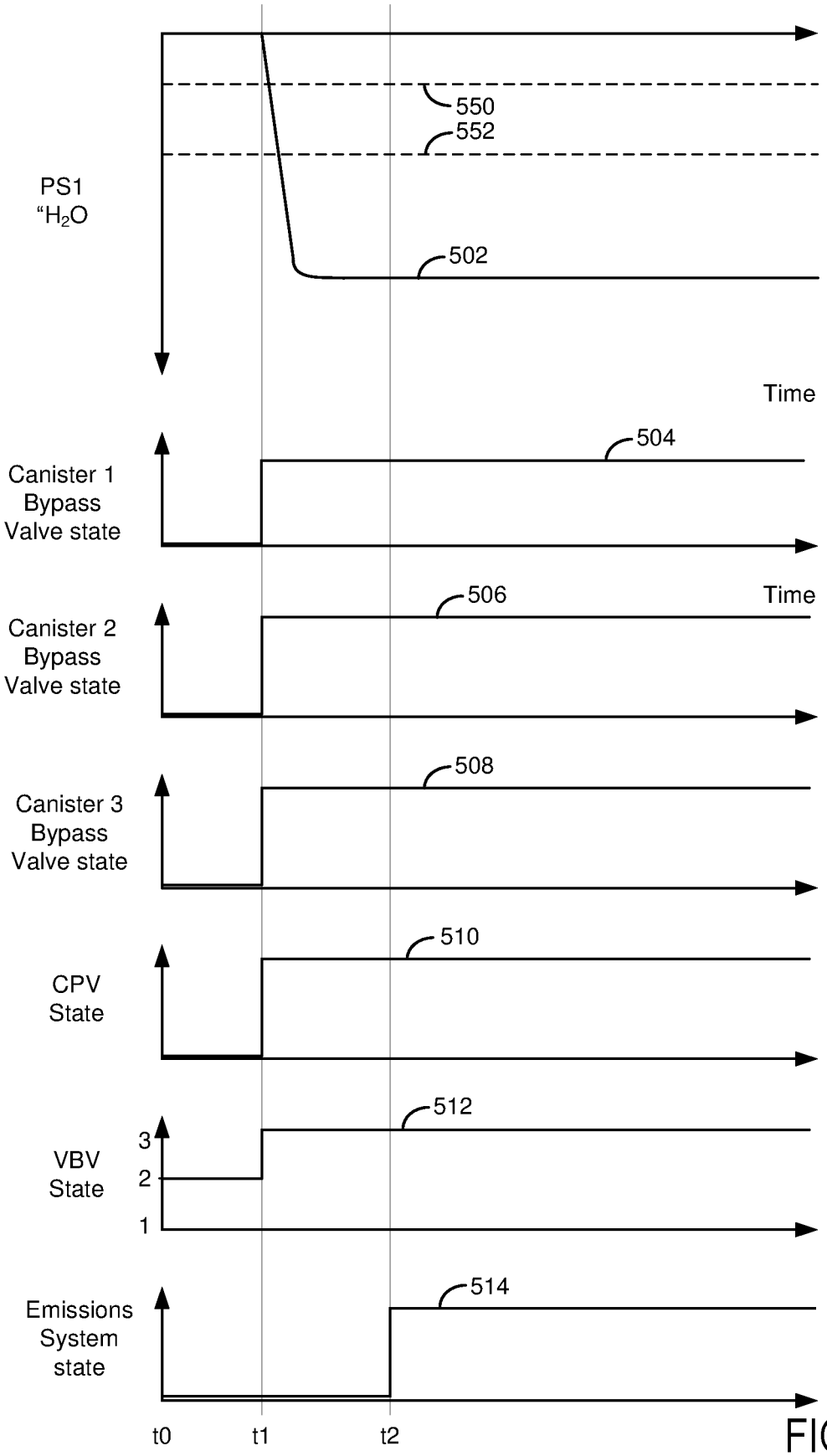
FIGS. 5 and 6 show example evaporative emissions system operating sequences.
Figure 6:
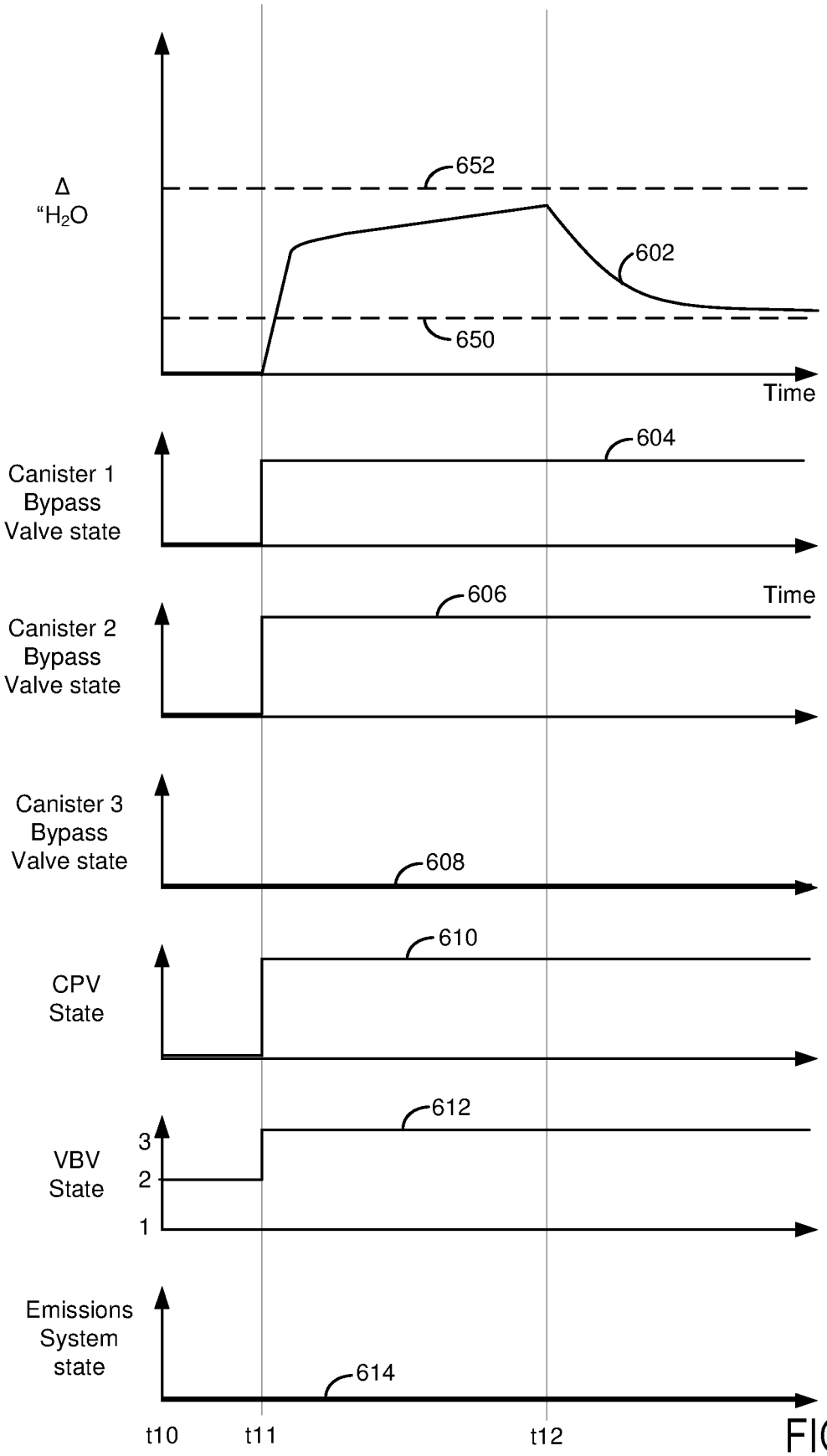
Figure 7:
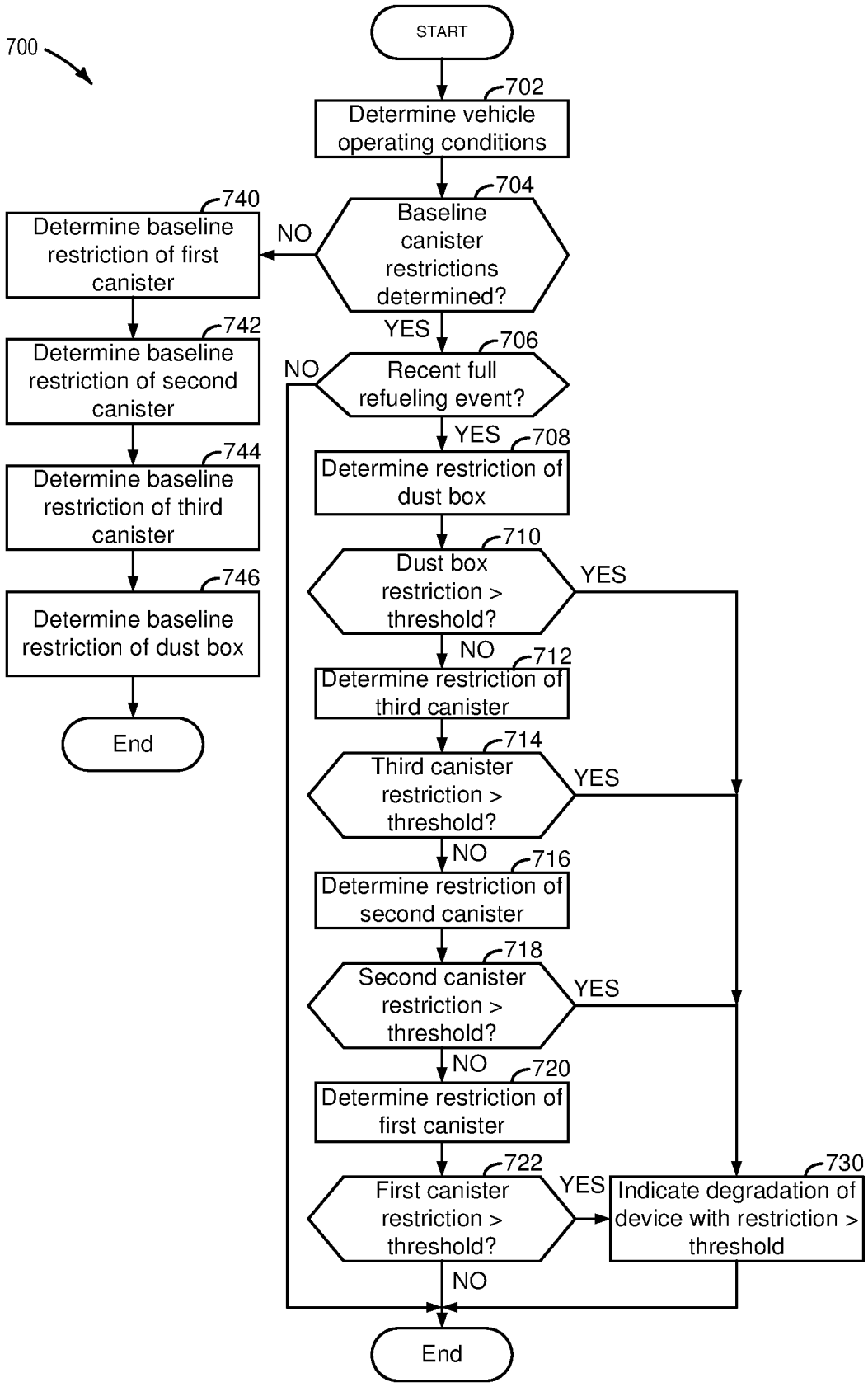
FIG. 7 shows an example method for operating an evaporative emissions system for an engine.

The following description relates to systems and methods for storing fuel vapors and diagnosing operation of a larger volume of fuel vapor storing material. In one example, the fuel vapor storing material is carbon pellets that are held in a canister. The fuel vapors may be associated with an engine of the type shown in FIG. 1. The engine may be part of a driveline or powertrain as shown in FIG. 2. The engine and powertrain may include an evaporative emissions system as shown in FIG. 3. A table that illustrates potential outcomes for a diagnostic sequence is shown in FIG. 4. Sequences for diagnosing operation of a dust box and a fuel vapor storage canister are shown in FIGS. 5 and 6. A method for operating an engine and an evaporative emissions system are shown in FIG. 7.

Figure 1:
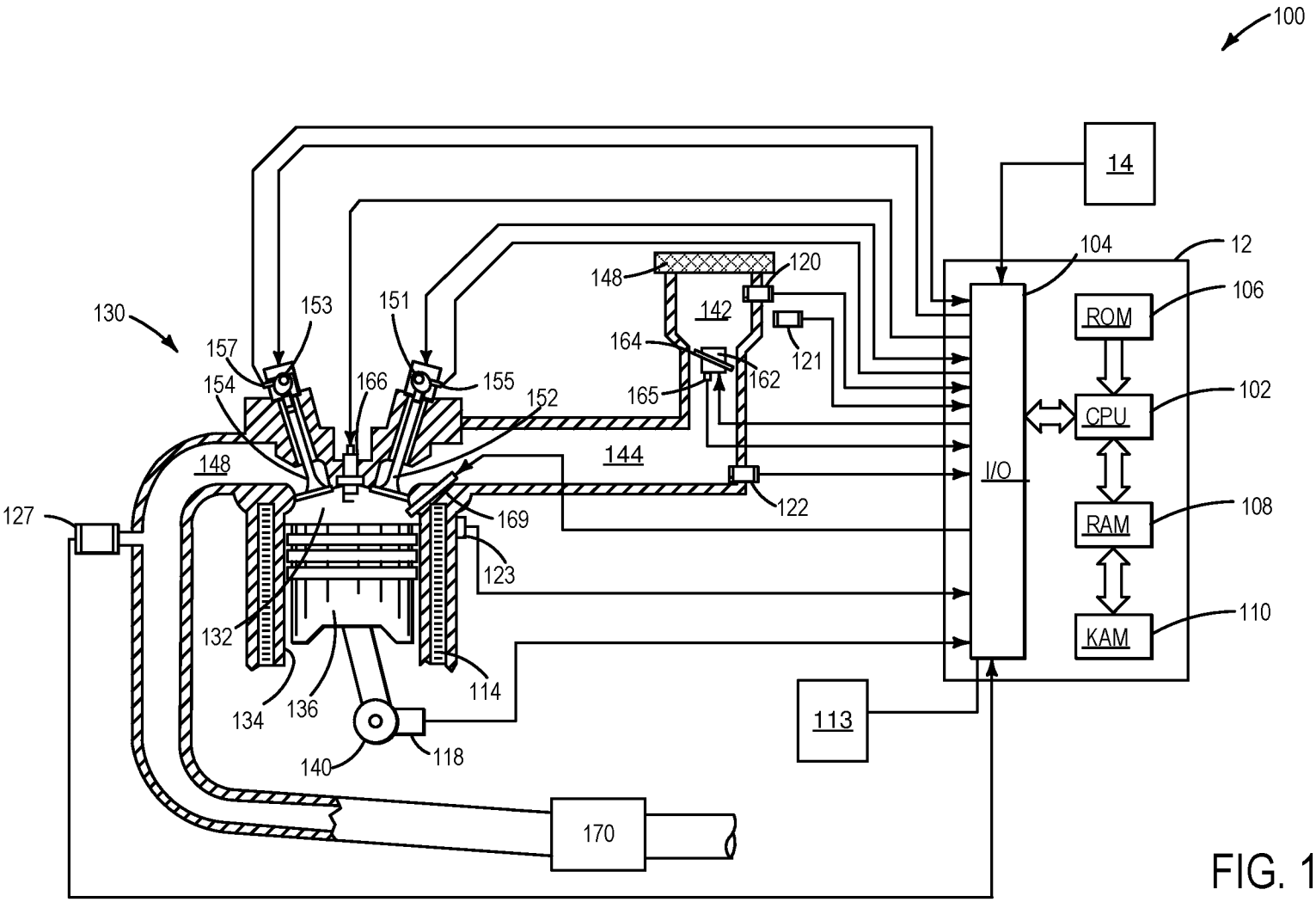
FIG. 1 shows an example internal combustion engine of a vehicle.

Referring now to FIG. 1, a schematic diagram showing one cylinder of a multi-cylinder engine 130 in an engine system 100 is shown. Engine 130 may be controlled at least partially by a control system including a controller 12 and by input from an autonomous driver or controller 14. Alternatively, a vehicle operator (not shown) may provide input via an input device, such as an engine torque, power, or air amount input pedal (not shown).

A combustion chamber 132 of the engine 130 may include a cylinder formed by cylinder walls 134 with a piston 136 positioned therein. The piston 136 may be coupled to a crankshaft 140 so that reciprocating motion of the piston is translated into rotational motion of the crankshaft. The crankshaft 140 may be coupled to at least one drive wheel of a vehicle via an intermediate transmission system. Further, a starter motor (not shown) may be coupled to the crankshaft 140 via a flywheel to enable a starting operation of the engine 130.

Combustion chamber 132 may receive intake air from an intake manifold 144 via an intake passage 142 and may exhaust combustion gases via an exhaust passage 148. The intake passage 142 includes an intake air filter 148. The intake manifold 144 and the exhaust passage 148 can selectively communicate with the combustion chamber 132 via respective intake valve 152 and exhaust valve 154. In some examples, the combustion chamber 132 may include two or more intake valves and/or two or more exhaust valves.

In this example, the intake valve 152 and exhaust valve 154 may be controlled by cam actuation via respective cam actuation systems 151 and 153. The cam actuation systems 151 and 153 may each include one or more cams and may utilize one or more of cam profile switching (CPS), variable cam timing (VCT), variable valve timing (VVT), and/or variable valve lift (VVL) systems that may be operated by the controller 12 to activate, deactivate (e.g., hold in a closed position for an engine cycle of two revolutions), and vary timing of valve operation. The position of the intake valve 152 and exhaust valve 154 may be determined by position sensors 155 and 157, respectively. In alternative examples, the intake valve 152 and/or exhaust valve 154 may be controlled by electric valve actuation. For example, the cylinder 132 may alternatively include an intake valve controlled via electric valve actuation and an exhaust valve controlled via cam actuation including CPS and/or VCT systems.

A fuel injector 169 is shown coupled directly to combustion chamber 132 for injecting fuel directly therein in proportion to the pulse width of a signal received from the controller 12. In this manner, the fuel injector 169 provides what is known as direct injection of fuel into the combustion chamber 132. The fuel injector may be mounted in the side of the combustion chamber or in the top of the combustion chamber, for example. Fuel may be delivered to the fuel injector 169 by a fuel system (not shown) including a fuel tank, a fuel pump, and a fuel rail. In some examples, the combustion chamber 132 may alternatively or additionally include a fuel injector arranged in the intake manifold 144 in a configuration that provides what is known as port injection of fuel into the intake port upstream of the combustion chamber 132.

Spark is provided to combustion chamber 132 via spark plug 166. The ignition system may further comprise an ignition coil (not shown) for increasing voltage supplied to spark plug 166. In other examples, such as a diesel, spark plug 166 may be omitted.

The intake passage 142 may include an intake throttle 162 having a throttle plate 164. In this particular example, the position of throttle plate 164 may be varied by the controller 12 via a signal provided to an electric motor or actuator included with the throttle 162, a configuration that is commonly referred to as electronic throttle control (ETC). In this manner, the throttle 162 may be operated to vary the intake air provided to the combustion chamber 132 among other engine cylinders. The position of the throttle plate 164 may be provided to the controller 12 by a throttle position signal. The intake passage 142 may include a mass air flow sensor 120 and a manifold air pressure sensor 122 for sensing an amount of air entering engine 130. Barometric pressure may be determined via sensor 121.

An exhaust gas sensor 127 is shown coupled to the exhaust passage 148 upstream of an emission control device 170 according to a direction of exhaust flow. The sensor 127 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_R$, HC, or CO sensor. In one example, upstream exhaust gas sensor 127 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 170 is shown arranged along the exhaust passage 148 downstream of the exhaust gas sensor 127. The device 170 may be a three way catalyst (TWC), $NO_R$ trap, various other emission control devices, or combinations thereof. In some examples, during operation of the engine 130, the emission control device 170 may be periodically reset by operating at least one cylinder of the engine within a particular air-fuel ratio.

The controller 12 is shown in FIG. 1 as a microcomputer, including a microprocessor unit 102, input/output ports 104, an electronic storage medium for executable programs and calibration values shown as read only memory chip 306 (e.g., non-transitory memory) in this particular example, random access memory 108, keep alive memory 110, and a data bus. The controller 12 may receive various signals from sensors coupled to the engine 130, in addition to those signals previously discussed, including measurement of inducted mass air flow (MAF) from the mass air flow sensor 120; engine coolant temperature (ECT) from a temperature sensor 123 coupled to a cooling sleeve 114; an engine position signal from a Hall effect sensor 118 (or other type) sensing a position of crankshaft 140; throttle position from a throttle position sensor 165; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 144. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 (e.g., non-transitory memory) can be programmed with computer readable data representing non-transitory instructions executable by the processor 102 for performing at least portions of the methods described below as well as other variants that are anticipated but not specifically listed. CPU 102 may sample output of one or more sensors via A/D converters within I/O 104 and store the voltage/pressures/etc. to RAM memory. Thus, controller 12 may operate actuators to change operation of engine 130. In addition, controller 12 may post data, messages, and status information to human/machine interface 113 (e.g., a touch screen display, heads-up display, light, etc.).

During operation, each cylinder within engine 130 typically undergoes a four stroke cycle: the cycle includes the intake stroke, compression stroke, expansion stroke, and exhaust stroke. During the intake stroke, generally, the exhaust valve 154 closes and intake valve 152 opens. Air is introduced into combustion chamber 132 via intake manifold 144, and piston 136 moves to the bottom of the cylinder so as to increase the volume within combustion chamber 132. The position at which piston 136 is near the bottom of the cylinder and at the end of its stroke (e.g. when combustion chamber 132 is at its largest volume) is typically referred to by those of skill in the art as bottom dead center (BDC).

During the compression stroke, intake valve 152 and exhaust valve 154 are closed. Piston 136 moves toward the cylinder head so as to compress the air within combustion chamber 132. The point at which piston 136 is at the end of its stroke and closest to the cylinder head (e.g. when combustion chamber 132 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 166, resulting in combustion.

During the expansion stroke, the expanding gases push piston 136 back to BDC. Crankshaft 140 converts piston movement into a rotational torque of the rotary shaft. Finally, during the exhaust stroke, the exhaust valve 154 opens to release the combusted air-fuel mixture to exhaust manifold 148 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc.

Referring now to FIG. 2, a schematic of a vehicle drive-train 200 is shown. Drive-train 200 may be powered by engine 130 as shown in greater detail in FIG. 1. In one example, engine 130 may be a gasoline engine. In alternate examples, other engine configurations may be employed. Engine 130 may be started with an engine starting system (not shown). Further, engine 130 may generate or adjust torque via torque actuator 204, such as a fuel injector, throttle, cam, etc.

An engine output torque may be transmitted to torque converter 206 to drive a step-ratio automatic transmission 208 by engaging one or more clutches, including forward clutch 210, where the torque converter may be referred to as a component of the transmission. Torque converter 206 includes an impeller 220 that transmits torque to turbine 222 via hydraulic fluid. One or more gear clutches 224 may be engaged to change gear ratios between engine 230 and vehicle wheels 214. The output of the torque converter 206 may in turn be controlled by torque converter lock-up clutch 212. As such, when torque converter lock-up clutch 212 is fully disengaged, torque converter 206 transmits torque to automatic transmission 208 via fluid transfer between the torque converter turbine 222 and torque converter impeller 220, thereby enabling torque multiplication. In contrast, when torque converter lock-up clutch 212 is fully engaged, the engine output torque is directly transferred via the torque converter clutch 212 to an input shaft of transmission 208. Alternatively, the torque converter lock-up clutch 212 may be partially engaged, thereby enabling the amount of torque relayed to the transmission to be adjusted. A controller 12 may be configured to adjust the amount of torque transmitted by the torque converter by adjusting the torque converter lock-up clutch in response to various engine operating conditions, or based on a driver-based engine operation request.

Torque output from the automatic transmission 208 may in turn be transferred to wheels 214 to propel the vehicle. Specifically, automatic transmission 208 may adjust an input driving torque at the input shaft (not shown) responsive to a vehicle traveling condition before transmitting an output driving torque to the wheels. Vehicle speed may be determined via speed sensor 230.

Further, wheels 214 may be locked by engaging wheel brakes 216. In one example, wheel brakes 216 may be engaged in response to the driver pressing his foot on a brake pedal (not shown). In the similar way, wheels 214 may be unlocked by disengaging wheel brakes 216 in response to the driver releasing his foot from the brake pedal.

Referring now to FIG. 3, a block diagram of an example evaporative emissions system 300 is shown. Evaporative emissions system 300 includes a canister purge valve (CPV) 302, a first carbon filled canister 304, a second carbon filled canister 306, a third carbon filled canister 308, a canister vent valve (CVV) 310, a dust box 312, a vapor blocking valve (VBV) 375, and a fuel tank 320. Carbon filled canisters 304-308 may include activated carbon 311 to store fuel vapors. The system of FIG. 3 shows three carbon filled canisters, but the principals and methods described herein may be applied to evaporative emissions systems with two carbon filled canisters or more than three carbon filled canisters. Three existing smaller volume carbon filled canisters may be less expensive than one larger carbon filled canister that has the same volume as the three smaller volume carbon filled canisters.

Canister purge valve 302 may selectively provide fluidic communication between first carbon filled canister 304 and intake manifold 144. Absolute pressure sensor PS1 303 is positioned along conduit 340 between canister purge valve 302 and first carbon filled canister 304. Pressure sensor PS1 303 may output an electric current, voltage, digital data (e.g., binary or hexadecimal values communicated from the sensor) and the output of sensor 303 is input to controller 12. Controller 12 may also adjust operating states of each valve shown in FIG. 3. Controller 12 may also receive output from fuel tank pressure sensor 314. Canister purge valve 302 and canister vent valve 310 may be opened when fuel vapors are stored in at least one of first, second, and third carbon filled canisters 304-308. Air may be draw from atmosphere via engine vacuum from within intake manifold 144 when canister purge valve 302 and canister vent valve 310 are open. Each of carbon filled canisters 304-308 include a vent port (e.g., 304*a*, 306*a*, and 308*a*), a load port 371 (e.g., 304*b*, 306*b*, and 308*b*), and a purge port (e.g. 304*c*, 306*c*, and 308*c*). The purge ports 306*c* and 308*c* are plugged.

In one example, vapor blocking valve 375 is a three position valve. In a first position (default state), vapor blocking valve 375 allows flow between load port 375*c* and fuel tank port 375*a*. Communication between purge port 375*b* and other ports is blocked or not permitted in the first position. In a second position (solenoid 1 activated), vapor blocking valve 375 blocks communication between all ports (375*a*, 375*b*, and 375*c*). In a third position (second solenoid activated), vapor blocking valve 375 allows communication between purge port 375*a* and load port 375*c*. Communication between fuel tank port 375*a* and other ports is blocked or not permitted in the third position.

Conduit 339 provides fluid communication between intake manifold 144 and canister purge valve 302. Conduit 340 provides fluid communication between canister purge valve 302 and first carbon canister 304. Conduit 346 provides fluid communication between third carbon canister 308 and canister vent valve 310. Conduit 354 provides fluid communication between first carbon canister 304 and second carbon canister 306. Conduit 350 provides fluid communication between third carbon canister 308 and second carbon canister 306.

First carbon filled canister 304 includes a bypass passage or conduit 356 and a bypass valve 316 for selectively allowing and preventing air flow through conduit 356.

Similarly, second carbon filled canister 306 includes a bypass passage or conduit 352 and a bypass valve 318 for selectively allowing and preventing air flow through conduit 352. Likewise, third carbon filled canister 308 includes a bypass passage or conduit 348 and a bypass valve 320 for selectively allowing and preventing air flow through conduit 348. Thus, conduits 348, 352, and 356 may allow air to flow around carbon filled canisters 304, 306, and 308. For example, if bypass valve 320 is open, air may be drawn from atmosphere and through passage 348 without passing through carbon filled canister 308 so that it may eventually be drawn into intake manifold 144. The air flow may follow the path of least resistance, which may be through a bypass passage if the bypass passage's bypass valve is open.

Thus, the system of FIGS. 1-3 provides for a vehicle system, comprising: an engine; at least two fuel vapor storage canisters fluidically coupled in series; a conduit coupling the canister purge valve to a first of the at least two fuel vapor storage canisters; a canister purge valve fluidly coupled to the engine and the first of the at least two fuel vapor storage canisters; and a pressure sensor positioned along the conduit between the canister purge valve and the first of the at least two fuel vapor storage canisters. The vehicle system further comprises a bypass passage for each of the at least two fuel vapor storage canisters. The vehicle system further comprises a bypass valve for each bypass passage. The vehicle system further comprises a controller including executable instructions stored in non-transitory memory that cause the controller to estimate a pressure change across the first of the at least two fuel vapor storage canisters according to pressure representations provided solely via the pressure sensor. The vehicle system includes where the pressure representations include one of a voltage, a current, and digital data. The vehicle system further comprises additional instructions to indicate a status of the first of the at least two fuel vapor storage canisters in response to the pressure change. The vehicle system further comprises additional executable instructions to estimate a pressure change across a second of the at least two fuel vapor storage canisters according to pressure representations provided solely via the pressure sensor.

Referring now to FIG. 4, a table of example conditions for the evaporative emissions system of FIG. 3 is shown. Table 400 includes five rows (408-416) and three columns (402-406). The first row, first column, entry indicates that the first column of each subsequent row displays the excitation source for pulling air from ambient air to the engine intake manifold. The first row, second column, entry indicates that the second column of each subsequent row displays the pressure level as measured in absolute pressure when ambient air is pulled through the evaporative emissions system and into the engine intake manifold. The first row, third column, entry indicates that the third column of each subsequent row displays an inferred condition of the evaporative emissions system when ambient air is pulled through the evaporative emissions system and into the engine intake manifold.

At row two, column one, when engine intake manifold vacuum is applied to pull ambient air through the evaporative emissions system (row two, column one), a pressure of zero inches of water absolute pressure may be indicated at pressure sensor PS1 when there is a missing first carbon filled canister in the evaporative emissions system. At row three, column one, when engine intake manifold vacuum is applied to pull ambient air through the evaporative emissions system (row three, column one), a pressure of twelve inches of water absolute pressure may be indicated at pressure sensor PS1 when there is a first carbon filled canister that is loaded with fuel vapor in the evaporative emissions system. At row three, column 1 when engine intake manifold vacuum is applied to pull ambient air through the evaporative emissions system (row three, column one), a pressure of six inches of water absolute pressure may be indicated at pressure sensor PS1 when there is an unloaded new or baseline first carbon filled canister in the evaporative emissions system. At row four, column one when engine intake manifold vacuum is applied to pull ambient air through the evaporative emissions system (row four, column one), a pressure of twenty inches of water absolute pressure may be indicated at pressure sensor PS1 303 when there is a first carbon filled canister is degraded in the evaporative emissions system.

Referring now to FIG. 5, an example sequence for evaluating a restriction of a dust box is shown. The sequence of FIG. 5 may be provided by the system of FIGS. 1-3 in cooperation with the method of FIG. 7. Vertical markers at times t0-t2 represent times of interest during the sequence. All of the plots occur at a same time.

The first plot from the top of FIG. 5 is a plot of an absolute pressure at the location of pressure sensor PS1 versus time. The vertical axis represents the absolute pressure and the magnitude of the absolute pressure increases in the direction of the vertical axis arrow. The absolute pressure is zero at the level of the horizontal axis. Pressures below the horizontal axis are negative, thereby indicating a vacuum level. The horizontal axis represents time and time increases in the direction of the horizontal axis arrow. Trace 502 represents the absolute pressure at the location of sensor PS1. Horizontal line 550 represents a baseline absolute pressure when a dust box is new, when valves 302, 310, 320, 318, and 316 are commanded open, and when valve 375 is in its third position (e.g., communication between port 375*b* and port 375*c*). Horizontal line 552 represents a minimum acceptable absolute pressure level when a dust box is being evaluated, when valves 302, 310, 320, 318, and 316 are commanded open, and when valve 375 is in its third position (e.g., communication between port 375*b* and port 375*c*).

The second plot from the top of FIG. 5 is a plot of the first canister bypass valve state versus time. The vertical axis represents the first canister bypass valve state and the first canister bypass valve state is fully open when trace 504 is at a higher level near the vertical axis arrow. The first canister bypass valve is fully closed when trace 504 is at a lower level near the horizontal axis. Trace 504 represents the first canister bypass valve state.

The third plot from the top of FIG. 5 is a plot of the second canister bypass valve state versus time. The vertical axis represents the second canister bypass valve state and the second canister bypass valve state is fully open when trace 506 is at a higher level near the vertical axis arrow. The second canister bypass valve is fully closed when trace 506 is at a lower level near the horizontal axis. Trace 506 represents the second canister bypass valve state.

The fourth plot from the top of FIG. 5 is a plot of the third canister bypass valve state versus time. The vertical axis represents the third canister bypass valve state and the third canister bypass valve state is fully open when trace 508 is at a higher level near the vertical axis arrow. The third canister bypass valve is fully closed when trace 508 is at a lower level near the horizontal axis. Trace 508 represents the third canister bypass valve state.

The fifth plot from the top of FIG. 5 is a plot of the canister purge valve (CPV) state versus time. The vertical axis represents the CPV state and the CPV is fully open when trace 510 is at a higher level near the vertical axis arrow. The CPV is fully closed when trace 510 is at a lower level near the horizontal axis. Trace 510 represents the CPV state.

The sixth plot from the top of FIG. 5 is a plot of the vapor blocking valve (VBV) state versus time. The vertical axis represents the VBV state and the VBV may be in one of three possible states. In a first position (e.g., first state), vapor blocking valve 375 allows flow between load port 375*c* and fuel tank port 375*a*. Communication between purge port 375*b* and other ports is blocked or not permitted in the first position. In a second position (e.g., second state), vapor blocking valve 375 blocks communication between all ports (375*a*, 375*b*, and 375*c*). In a third position (e.g., third state), vapor blocking valve 375 allows communication between purge port 375*b* and load port 375*c*. Communication between fuel tank port 375*a* and other ports is blocked or not permitted in the third position. Trace 512 represents the VBV state.

The seventh plot from the top of FIG. 5 is a plot of the emission system state versus time. The vertical axis represents the emission system state and the emission system state is indicated as degraded (e.g., not performing as may be expected) when trace 514 is at a higher level near the vertical axis arrow. The emission system state is not degraded (e.g., performing as may be expected) when trace 514 is at a lower level near the horizontal axis. Trace 514 represents the emission system state.

At time t0, the engine (not shown) is running (e.g., rotating and combusting fuel) and the CPV is closed. The absolute pressure observed at PS1 is zero and the canister bypass valves for the three carbon filled canisters (304-308) are closed. The VBV is in a second state where its ports are closed and the emissions system is not indicated as degraded.

At time t1, the engine (not shown) remains running and a diagnostic for evaporative emission system's dust box begins. The magnitude of the absolute pressure observed at PS1 begins to increase in response to the first, second, and third canister bypass valves opening, the CPV opening, and the VBV opening (the VBV is adjusted to its $3^{rd}$ operating state). By opening the bypass valves, the CPV, and the VBV ambient air may be drawn into the evaporative emissions system and opening the bypass valves allows the air to bypass the three carbon filled canisters so that the absolute pressure observed at pressure sensor PS1 is substantially equal to the absolute pressure on the evaporative emissions system side of the dust box. Air may flow from the dust box to the intake manifold due to vacuum in the intake manifold.

Between time t1 and time t2, the magnitude of absolute pressure at pressure sensor PS1 increases such that it exceeds thresholds 550 and 552. Once threshold 552 is exceeded an indication of evaporative emissions system degradation may be indicated. In this example, evaporative emissions system degradation is indicted at time t2, which is a predetermined amount of time after threshold 552 was exceeded. The predetermined amount of time allows the system time to make sure that exceeding threshold 552 is not a transient condition.

The desired absolute pressure at the location of pressure sensor PS1 is between threshold 550 and 552 when diagnosing/evaluating the dust box. The amount of restriction for a new dust box (e.g., a box that traps small particles of carbon that may exit the carbon filled canisters) may be indicated by the absolute pressure at the level of threshold 550. Acceptable restriction levels of partially filled dust boxes are within the absolute pressure range level between threshold 550 and threshold 552. If the amount of dust held in the dust box causes an absolute pressure with a magnitude that is above threshold 552, it may be desirable to replace or empty the dust box so that the restriction of the evaporative emissions system may be at expected levels. The vehicle may exhibit desirable levels of fuel economy and emissions when the restriction level of the evaporative emissions system is at an expected level. The vehicle may exhibit undesirable levels of fuel economy and emissions when the restriction level of the evaporative emissions system is not at an expected level.

In this way, an amount of restriction of a dust box positioned at an end of an evaporative emissions system may be determined via a single pressure sensor. The single pressure sensor may be located away from the dust box at the position of PS1 shown in FIG. 3. System cost may be reduced by avoiding application of several pressure sensors along the canister purge path to determine a pressure at the dust box.

Referring now to FIG. 6, an example sequence for evaluating a restriction of a carbon filled canister is shown. The sequence of FIG. 6 may be provided by the system of FIGS. 1-3 in cooperation with the method of FIG. 7. Vertical markers at times t10-t12 represent times of interest during the sequence. The evaporative emission system's three carbon filled canisters are loaded with fuel vapors at time t10. All of the plots occur at a same time.

The plots of FIG. 6, except the first plot, describe the same variables as the plots of FIG. 5. Therefore, for the sake of brevity, a description of the variables in FIG. 6 is omitted. In the example sequence of FIG. 6, restriction of a third canister (e.g., 308 of FIG. 3) is evaluated.

The first plot from the top of FIG. 6 is a plot of an absolute pressure change across the third carbon filled canister as determined via a pressure sensor at the location of pressure sensor PS1 versus time. The vertical axis represents the absolute pressure change and the magnitude of the absolute pressure change increases in the direction of the vertical axis arrow. The absolute pressure change is zero at the level of the horizontal axis. The horizontal axis represents time and time increases in the direction of the horizontal axis arrow. Trace 602 represents the absolute pressure change across the carbon filled canister as determined from pressure at the location of sensor PS1, which is substantially the pressure at the load port of the third canister. Horizontal line 650 represents a baseline pressure change when the third carbon filled canister is new, when valves 302, 310, 320, 318, and 316 are commanded open, and when valve 375 is in its third position (e.g., communication between port 375*b* and port 375*c*). Horizontal line 652 represents a maximum acceptable pressure change across the third carbon filled canister when the third carbon filled canister is being evaluated, when valves 302, 310, 320, 318, and 316 are commanded open, and when valve 375 is in its third position (e.g., communication between port 375*b* and port 375*c*).

At time t10, the engine (not shown) is running (e.g., rotating and combusting fuel) and the CPV is closed. The pressure change observed by pressure sensor PS1 is zero and the canister bypass valves for the three carbon filled canisters (304-308) are closed. The VBV is also closed (in its $2^{nd}$ operating state) and the emissions system is not indicated as degraded.

At time t11, the engine (not shown) remains running and a diagnostic for the evaporative emission system's third carbon filled canister begins. The pressure change observed at pressure sensor PS1 begins to increase in response to the first and second canister bypass valves opening, the CPV opening, and the VBV opening (e.g., the VBV is adjusted to its third operating state). The third canister bypass valve is held closed so that air that flows to the engine intake manifold has to flow through the third carbon filled canister. Substantially no air flows through the first and second carbon filled canisters because their bypass valves are held open. The pressure change that is observed at pressure sensor PS1 is substantially equal to the pressure at the load port (e.g., 308*b*) of the third carbon filled canister. Thus, the restriction of the third carbon filled canister may be determined according to the absolute pressure change across the third carbon filled canister.

Between time t11 and time t12, the pressure change across the third carbon filled canister as determined via pressure sensor PS1 increases such that it exceeds threshold 650. However, it is less than threshold 652, so emissions system degradation may not be present.

At time t12, the change in pressure across the third carbon filled canister begins to decline as fuel vapors are purged from the carbon filled canister (e.g., which also may be referred to as a fuel vapor storage canister). Emissions system degradation is not indicated since the pressure change across the third carbon filled canister is less than threshold 652.

In this way, an amount of restriction of a carbon filled canister may be determined via a single pressure sensor. The single pressure sensor may be located upstream from the carbon filled canister in a direction of air flow from the dust box to the engine intake manifold.

Referring now to FIG. 7, an example method 700 for determining restriction of devices in an evaporative emissions system is shown. The devices may include a dust box and a plurality of carbon filled canisters that are coupled in series. At least portions of method 700 may be included in and cooperate with a system as shown in FIGS. 1-3 as executable instructions stored in non-transitory memory. The method of FIG. 7 may cause the controller to actuate the actuators in the real world and receive data and signals from sensors described herein when the method is realized via executable instructions stored in controller memory. A vehicle's engine may be running (e.g., rotating and combusting fuel) when method 700

At 702, method 700 determines vehicle operating conditions. Vehicle operating conditions may include but are not limited to ambient air temperature, engine speed, engine air flow amount, driver demand torque or power, intake manifold pressure, spark timing, barometric pressure, intake inlet pressure, and engine air-fuel ratio. Method 700 may determine or infer these conditions from the various sensors mentioned herein. Method 700 proceeds to 704.

At 704, method 700 judges if pressures for baseline carbon filled canister restriction conditions have been determined. Pressures for baseline carbon filled canister restriction values may be determined at the time of vehicle manufacture or within a threshold distance traveled by a vehicle (e.g., 5,000 kilometers). The pressures for baseline carbon filled canister restriction values may be useful for determining if a canister is degraded, such as if the canister is cracked or is empty. A variable in controller memory may include a value that indicates whether or not the pressures for baseline carbon filled canister restriction values have been determined. If method 700 judges that the pressures for the baseline carbon filled canister restriction values have been determined, the answer is yes and method 700 proceeds to 706. Otherwise, the answer is no and method 700 proceeds to 740.

At 740, method 700 determines a pressure at the location of sensor PS1 that may be used to infer a restriction of the first carbon filled canister. Specifically, method 700 deactivates (e.g., closes) the bypass valve for the first carbon filled canister so that air may be passed through the first carbon filled canister rather than around the first carbon filled canister. Method 700 also activates (e.g., opens) the bypass valves for the second and third carbon filled canisters so that air may be passed around the second and third carbon filled canisters rather than through the second and third carbon filled canisters. Air may flow through the first carbon filled canister and into the engine intake manifold when the canister purge valve 302 and the canister vent valve 310 are open. The vapor blocking valve 375 is commanded to its second position (all ports blocked) so that air may be drawn from the vent port 304*a* of the first carbon filled canister to the purge port 304*c* of the carbon filled canister. The pressure observed via sensor PS1 303 is sampled and stored in controller memory as variable PS1can1base. Method 700 proceeds to 742.

At 742, method 700 determines a pressure at the location of sensor PS1 that may be used to infer a restriction of the second carbon filled canister. In particular, method 700 deactivates (e.g., closes) the bypass valve for the second carbon filled canister so that air may be passed through the second carbon filled canister rather than around the second carbon filled canister. Method 700 also activates (e.g., opens) the bypass valves for the first and third carbon filled canisters so that air may be passed around the first and third carbon filled canisters rather than through the first and third carbon filled canisters. Air may flow through the second carbon filled canister and into the engine intake manifold when the canister purge valve 302 and the canister vent valve 310 are open. The vapor blocking valve 375 is commanded to its third position (flow is permitted between load port 375*c* and purge port 375*b*) so that air may be drawn from the canister vent valve 310, through bypass passage 348, through second carbon filled canister 306, through bypass passage 356, through VBV 375, and through canister purge valve 302 to intake manifold 144. The pressure observed via sensor PS1 303 is sampled and stored in controller memory as variable PS1can2base. Method 700 proceeds to 744.

At 744, method 700 determines a pressure at the location of sensor PS1 that may be used to infer a restriction of the third carbon filled canister. In particular, method 700 deactivates (e.g., closes) the bypass valve for the third carbon filled canister so that air may be passed through the third carbon filled canister rather than around the third carbon filled canister. Method 700 also activates (e.g., opens) the bypass valves for the first and second carbon filled canisters so that air may be passed around the first and second carbon filled canisters rather than through the first and second carbon filled canisters. Air may flow through the third carbon filled canister and into the engine intake manifold when the canister purge valve 302 and the canister vent valve 310 are open. The vapor blocking valve 375 is commanded to its third position (flow is permitted between load port 375*c* and purge port 375*b*) so that air may be drawn from the canister vent valve 310, through third carbon filled canister 306, through bypass passage 352, through bypass passage 356, through VBV 375, and through canister purge valve 302 to intake manifold 144. The pressure observed via sensor PS1 303 is sampled and stored in controller memory as variable PS1can3base. Method 700 proceeds to 746.

At 746, method 700 determines a pressure change across the evaporative emissions system dust box 312 for a baseline restriction level of the evaporative emissions system dust box 312. To determine the pressure change across the dust box 312, method 700 opens the first 316, second 318, and third 320 canister bypass valves, opens the CPV 302, and commands the VBV 375 to its $3^{rd}$ operating state. By opening the bypass valves, the CPV, and the VBV ambient air may be drawn into the evaporative emissions system. Opening the three bypass valves allows the air to bypass the three carbon filled canisters so that the absolute pressure observed at pressure sensor PS1 is substantially equal to the absolute pressure on the evaporative emissions system side of the dust box. The pressure observed via sensor PS1 303 is sampled and stored in controller memory as variable PS1boxbase. Method 700 proceeds to exit.

At 706, method 700 judges if the fuel tank has been recently (e.g., within the last two hours) refueled to a full level. Method 700 may judge that the fuel tank has been recently refueled to the full level when the engine is started and the fuel tank level moves from a partially filled state to a full state. The fuel tank's level sensor may indicate the level of fuel in the fuel tank. If method 700 judges that the fuel tank has been recently refueled to a full level, the answer is yes and method 700 proceeds to 708. Otherwise, the answer is no and method 700 proceeds to exit.

At 708, method 700 determines a pressure change across evaporative emissions system dust box 312, which may be indicative of a restriction level of the evaporative emissions system dust box 312. Additionally, in some examples, method 700 may perform flow and pressure tests of the evaporative emissions system prior to assessing the pressure change across the dust box to verify evaporative emissions system integrity.

Method 700 assesses the pressure change across the evaporative emissions system dust box by opening the bypass valves for the carbon filled canisters (e.g., bypass valves for the first, second, and third carbon filled canisters). Method 700 also opens the CPV, CVV, and commands the VBV to its third position so that air may flow directly from the first canister bypass passage to absolute pressure sensor PS1 and the CPV. Once the aforementioned valves are in these positions and air flow to the intake manifold has stabilized (e.g., after a few seconds), the controller samples the output of the absolute pressure sensor PS1 and stores a pressure value to memory as variable PS1box.

In one example, method 700 compares the pressure sampled at PS1 with the baseline pressure measured at PS1 determined at 746 when the baseline dust box restriction pressure was determined. The comparison may be expressed via the following equation:

$$\Delta\text{dustbox}=PS1\text{boxbase}-PS1\text{box}$$

where Δdustbox is the pressure change from the baseline dust box pressure as determined at 746, PS1boxbase is the baseline dust box pressure, and PS1box is the pressure determined at the present step. Method 700 proceeds to 710.

At 710, method 700 judges if the restriction provided by the dust box is greater than a threshold. In one example, method 700 may infer that the restriction of the dust box to air flow through the dust box is greater than a threshold restriction if the value of Δdustbox is greater than a predetermined threshold. If method 700 judges that the restriction provided by the dust box is greater than a threshold restriction, the answer is yes and method 700 proceeds to 730. Otherwise, the answer is no and method 700 proceeds to 712.

At 730, method 700 indicates degradation of a device within the evaporative emissions system. Method 700 may also indicate which particular device is expected to be degraded. For example, if method 700 judges that the value of Δdustbox is greater than a predetermined threshold value, method 700 may indicate that the dust box is degraded. Likewise, if method 700 judges that the value of ΔPS1can1 is greater than a predetermined threshold value, method 700 may indicate that the first carbon filled canister is degraded. Method 700 may indicate that other carbon filled canisters are degraded or not degraded in a similar way. Method 700 may indicate that evaporative system components are degraded via displaying a message on a human/machine interface, sending a message to another controller, or via other known methods. Method 700 proceeds to exit.

At 712, method 700 determines a pressure change across evaporative emissions system third carbon filled canister 308, which may be indicative of a restriction level of the evaporative emissions system third carbon filled canister 308.

Method 700 assesses the pressure change across the evaporative emissions system third carbon filled canister by opening the two bypass valves (e.g., 316 and 318) for the first and second carbon filled canisters. Method 700 closes the bypass valve for the third carbon filled canister. Method 700 also opens the CPV, CVV, and commands the VBV to its third position so that air may flow directly from the first canister bypass passage to absolute pressure sensor PS1 and the CPV. Once the aforementioned valves are in these positions and air flow from the dust box to the intake manifold has stabilized (e.g., after a few seconds), the controller samples the output of the absolute pressure sensor PS1 and stores a pressure value to memory as variable PS1can3

In one example, method 700 determines the pressure change across the third carbon filled canister by subtracting PS1can3 from PS1box. The pressure change across the third carbon filled canister may be expressed via the following equation:

$$\Delta PS1\text{can3}=PS1\text{box}-PS1\text{can3}$$

where ΔPS1can3 is the pressure change across the third carbon filled canister, PS1box is the dust box pressure determined at 708, and PS1can3 is the pressure determined at the present step. Method 700 proceeds to 714.

Method 700 may also judge if the present pressure measured at sensor PS1 to determine the state of the third carbon filled canister is less than its base value PS1can3base. If so, method 700 may judge that the canister is not absorbing fuel vapor as expected and an indication of degradation may be provided. The present pressure measured at sensor PS1 may be expected to increase and then decrease as fuel vapor is purged from the third canister.

At 714, method 700 judges if the restriction provided by the third carbon filled canister is greater than a threshold. In one example, method 700 may infer that the restriction of the third carbon filled canister to air flow through the third carbon filled canister is greater than a threshold restriction if the value of ΔPS1can3 is greater than a predetermined threshold. If method 700 judges that the restriction provided by the third carbon filled canister is greater than a threshold restriction, the answer is yes and method 700 proceeds to 730. Otherwise, the answer is no and method 700 proceeds to 716.

At 716, method 700 determines a pressure change across evaporative emissions system second carbon filled canister 306, which may be indicative of a restriction level of the evaporative emissions system second carbon filled canister 306.

Method 700 assesses the pressure change across the evaporative emissions system second carbon filled canister by opening the two bypass valves (e.g., 316 and 320) for the first and third carbon filled canisters. Method 700 closes the bypass valve for the second carbon filled canister. Method 700 also opens the CPV, CVV, and commands the VBV to its third position so that air may flow directly from the first canister bypass passage to absolute pressure sensor PS1 and the CPV. Once the aforementioned valves are in these positions and air flow from the dust box to the intake manifold has stabilized (e.g., after a few seconds), the controller samples the output of the absolute pressure sensor PS1 and stores a pressure value to memory as variable PS1can2.

In one example, method 700 determines the pressure change across the second carbon filled canister by subtracting PS1can2 from PS1box. The pressure change across the second carbon filled canister may be expressed via the following equation:

$$\Delta PS1can2 = PS1box - PS1can2$$

where ΔPS1can2 is the pressure change across the second carbon filled canister, PS1box is the dust box pressure determined at 708, and PS1can2 is the pressure determined at the present step. Method 700 proceeds to 718.

Method 700 may also judge if the present pressure measured at sensor PS1 to determine the state of the second carbon filled canister is less than its base value PS1can2base. If so, method 700 may judge that the canister is not absorbing fuel vapor as expected and an indication of degradation may be provided. The present pressure measured at sensor PS1 may be expected to increase and then decrease as fuel vapor is purged from the second canister.

At 718, method 700 judges if the restriction provided by the second carbon filled canister is greater than a threshold. In one example, method 700 may infer that the restriction of the second carbon filled canister to air flow through the second carbon filled canister is greater than a threshold restriction if the value of ΔPS1can2 is greater than a predetermined threshold. If method 700 judges that the restriction provided by the second carbon filled canister is greater than a threshold restriction, the answer is yes and method 700 proceeds to 730. Otherwise, the answer is no and method 700 proceeds to 720.

At 720, method 700 determines a pressure change across evaporative emissions system first carbon filled canister 304, which may be indicative of a restriction level of the evaporative emissions system first carbon filled canister 304.

Method 700 assesses the pressure change across the evaporative emissions system first carbon filled canister by opening the two bypass valves (e.g., 318 and 320) for the second and third carbon filled canisters. Method 700 closes the bypass valve for the first carbon filled canister. Method 700 also opens the CPV, CVV, and commands the VBV to its second position so that air may flow directly from the second canister bypass passage to the first carbon filled canister and from the first carbon filled canister to the absolute pressure sensor PS1 and the CPV. Once the aforementioned valves are in these positions and air flow from the dust box to the intake manifold has stabilized (e.g., after a few seconds), the controller samples the output of the absolute pressure sensor PS1 and stores a pressure value to memory as variable PS1can1.

In one example, method 700 determines the pressure change across the second carbon filled canister by subtracting PS1can1 from PS1box. The pressure change across the first carbon filled canister may be expressed via the following equation:

$$\Delta PS1can1 = PS1box - PS1can1$$

where ΔPS1can1 is the pressure change across the first carbon filled canister, PS1box is the dust box pressure determined at 708, and PS1can1 is the pressure determined at the present step. Method 700 proceeds to 722.

Method 700 may also judge if the present pressure measured at sensor PS1 to determine the state of the first carbon filled canister is less than its base value PS1can3base. If so, method 700 may judge that the canister is not absorbing fuel vapor as expected and an indication of degradation may be provided. The present pressure measured at sensor PS1 may be expected to increase and then decrease as fuel vapor is purged from the first canister.

At 722, method 700 judges if the restriction provided by the first carbon filled canister is greater than a threshold. In one example, method 700 may infer that the restriction of the first carbon filled canister to air flow through the first carbon filled canister is greater than a threshold restriction if the value of ΔPS1can1 is greater than a predetermined threshold. If method 700 judges that the restriction provided by the first carbon filled canister is greater than a threshold restriction, the answer is yes and method 700 proceeds to 730. Otherwise, the answer is no and method 700 proceeds to exit.

In this way, method 700 may determine a pressure change across each carbon filled canister of the evaporative emissions system and the dust box. The pressure changes may be indicative of restrictions of the devices in the evaporative emissions system. Further, the restrictions of the devices may be indicative of degraded carbon with reduced capacity to store fuel vapors. As such, the pressure changes across the emissions devices may be indicative of an evaporative emissions system that may not meet an emissions standard.

Thus, the method of FIG. 7 provides for a method for operating an engine, comprising: estimating a pressure change across a fuel vapor storage canister via a controller according to a first pressure and a second pressure, the first pressure and second pressure indicated via a pressure sensor; and indicating a presence or absence of a restriction of the fuel vapor storage canister that is greater than a threshold according to the pressure change across the fuel vapor storage canister via the controller. The method further comprises indicating that the fuel vapor storage canister is degraded in response to the restriction of the fuel vapor storage canister being greater than the threshold. The method further comprises estimating a pressure change across a second fuel vapor storage canister according to a third pressure and a fourth pressure, the third pressure and fourth pressure indicated via the pressure sensor. The method further comprises estimating a pressure change across a third fuel vapor storage canister according to a fifth pressure and a sixth pressure, the fifth pressure and sixth pressure indicated via the pressure sensor. The method further comprises estimating a pressure change across a dust box according to a seventh pressure and an eighth pressure, the seventh pressure indicated via the pressure sensor. The method includes where the first fuel vapor storage canister, the second fuel vapor storage canister, the third fuel vapor storage canister, and the dust box are arranged in series. The method includes where the first fuel vapor storage canister is coupled to the second fuel vapor storage canister via a conduit. The method includes where the second fuel vapor storage canister and the third fuel vapor storage canister are coupled via a conduit.

The method of FIG. 7 also provides for a method for operating an engine, comprising: adjusting an operating state of a fuel vapor canister bypass valve to open via a controller; adjusting the operating state of the fuel vapor canister bypass valve to closed via the controller; sampling output of a pressure sensor while the operating state of the fuel vapor canister bypass valve is open; sampling output of the pressure sensor while the operating state of the fuel vapor canister is closed; and indicating a presence or absence of a restriction of a fuel vapor storage canister that is greater than a threshold according to a pressure change across the fuel vapor storage canister via the controller. The method further comprises bypassing the fuel vapor storage canister while storing fuel vapors to a second fuel vapor storage canister in response to the indication of the presence of the restriction of the fuel vapor storage canister. The method further comprises bypassing the fuel vapor storage canister while releasing fuel vapors from a second fuel vapor storage canister in response to the indication of the presence of the restriction of the fuel vapor storage canister. The method includes where the pressure change is determined from a first pressure and a second pressure, the first pressure and the second pressure based on the sampled output of the pressure sensor. The method includes where the first pressure is determined while the fuel vapor canister bypass valve is open, and where the second pressure is determined while the fuel vapor canister bypass valve is closed.

Note that the example control and estimation routines included herein can be used with various engine and/or vehicle system configurations. Further, the methods described herein may be a combination of actions taken by a controller in the physical world and instructions within the controller. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A vehicle system, comprising:

an engine;

at least two fuel vapor storage canisters fluidically coupled in series;

a conduit coupling the canister purge valve to a first of the at least two fuel vapor storage canisters;

a canister purge valve fluidly coupled to the engine and the first of the at least two fuel vapor storage canisters;

a pressure sensor positioned along the conduit between the canister purge valve and the first of the at least two fuel vapor storage canisters; and a controller including executable instructions stored in non-transitory memory that cause the controller to estimate a pressure change across the first of the at least two fuel vapor storage canisters according to pressure representations provided solely via the pressure sensor.

2. The vehicle system of claim 1, further comprising a bypass passage for each of the at least two fuel vapor storage canisters.

3. The vehicle system of claim 2, further comprising a bypass valve for each bypass passage.

4. The vehicle system of claim 2, where the pressure representations include one of a voltage, a current, and digital data.

5. The vehicle system of claim 1, further comprising additional instructions to indicate a status of the first of the at least two fuel vapor storage canisters in response to the pressure change.

6. The vehicle system of claim 1, further comprising additional executable instructions to estimate a pressure change across a second of the at least two fuel vapor storage canisters according to pressure representations provided solely via the pressure sensor.

7. A method for operating an engine, comprising:

estimating a pressure change across a fuel vapor storage canister via a controller according to a first pressure and a second pressure, the first pressure and second pressure indicated via a pressure sensor;

indicating a presence or absence of a restriction of the fuel vapor storage canister that is greater than a threshold according to the pressure change across the fuel vapor storage canister via the controller; and estimating another pressure change across a second fuel vapor storage canister according to a third pressure and a fourth pressure, the third pressure and fourth pressure indicated via the pressure sensor.

8. The method of claim 7, further comprising indicating that the fuel vapor storage canister is degraded in response to the restriction of the fuel vapor storage canister being greater than the threshold.

9. The method of claim 7, further comprising estimating a third pressure change across a third fuel vapor storage canister according to a fifth pressure and a sixth pressure, the fifth pressure and sixth pressure indicated via the pressure sensor.

10. The method of claim 9, further comprising estimating a fourth pressure change across a dust box according to a seventh pressure and an eighth pressure, the seventh pressure indicated via the pressure sensor.

11. The method of claim 10, where the first fuel vapor storage canister, the second fuel vapor storage canister, the third fuel vapor storage canister, and the dust box are arranged in series.

12. The method of claim 11, where the first fuel vapor storage canister is coupled to the second fuel vapor storage canister via a conduit.

13. The method of claim 12, where the second fuel vapor storage canister and the third fuel vapor storage canister are coupled via a conduit.

14. A method for operating an engine, comprising:

adjusting an operating state of a fuel vapor canister bypass valve to open via a controller;

adjusting the operating state of the fuel vapor canister bypass valve to closed via the controller;

sampling output of a pressure sensor while the operating state of the fuel vapor canister bypass valve is open;

sampling output of the pressure sensor while the operating state of the fuel vapor canister is closed; and indicating a presence or absence of a restriction of a fuel vapor storage canister that is greater than a threshold according to a pressure change across the fuel vapor storage canister via the controller.

15. The method of claim 14, further comprising bypassing the fuel vapor storage canister while storing fuel vapors to a second fuel vapor storage canister in response to the indication of the presence of the restriction of the fuel vapor storage canister.

16. The method of claim 14, further comprising bypassing the fuel vapor storage canister while releasing fuel vapors from a second fuel vapor storage canister in response to the indication of the presence of the restriction of the fuel vapor storage canister.

17. The method of claim 14, where the pressure change is determined from a first pressure and a second pressure, the first pressure and the second pressure based on the sampled output of the pressure sensor.

18. The method of claim 17, where the first pressure is determined while the fuel vapor canister bypass valve is open, and where the second pressure is determined while the fuel vapor canister bypass valve is closed.

* * * * *